United States Patent [19]

Phillips

[11] Patent Number: 4,522,189

[45] Date of Patent: Jun. 11, 1985

[54] ADJUSTABLE CAM BAR ASSEMBLY

[75] Inventor: James D. Phillips, Posen, Mich.

[73] Assignee: J. D. Phillips Corporation, Alpena, Mich.

[21] Appl. No.: 517,998

[22] Filed: Jul. 28, 1983

[51] Int. Cl.[3] ..... B29B 53/00

[52] U.S. Cl. ..... 125/11 TP; 125/11 CC; 269/137

[58] Field of Search ..... 125/11 R, 11 TP, 11 CC; 269/137

[56] References Cited

U.S. PATENT DOCUMENTS

| | | | |
|---|---|---|---|
| 2,229,280 | 1/1941 | Ekholm | 125/11 TP |
| 2,351,269 | 6/1944 | Kropf | 125/11 TP |
| 2,658,500 | 11/1953 | Hoglund | 125/11 TP |
| 3,090,612 | 5/1963 | Rouse | 269/137 |
| 3,908,627 | 9/1975 | Price | 125/11 TP |

*Primary Examiner*—Harold D. Whitehead

*Attorney, Agent, or Firm*—Barnes, Kisselle, Raisch, Choate, Whittemore & Hulbert

[57] ABSTRACT

An adjustable cam bar assembly for use in guiding a diamond dresser for the grinding wheels of a multi-wheel grinder. A plurality of cams are individually mounted on an elongated support in adjusted position. Wedges engageable with the cams are advanced or retracted to precisely locate the cams. The cams are then clamped in their adjusted positions.

5 Claims, 3 Drawing Figures

ADJUSTABLE CAM BAR ASSEMBLY

This invention relates to an adjustable cam bar assembly for use in guiding a dresser for the grinding wheels of a multi-wheel grinder or the like.

BACKGROUND AND SUMMARY OF THE INVENTION

At the present time, cam bar assemblies have matched sets of cams which are made to extremely close tolerances at great expense and are non-adjustably mounted on the cam bar. When one of the cams becomes damaged or worn out, it is necessary to replace the entire set of cams with a new matched set since it is virtually impossible to have replacements made with the necessary high degree of accuracy.

In accordance with the present invention, the individual cams are adjustably mounted on the cam bar. The cams are much less expensive to make because such extremely close tolerances as are now required are unnecessary. The cams are capable of being positioned with great accuracy when setting up the machine. Adjustments can easily be made and individual cams may be replaced when necessary. Set-up of the cams can be made quickly, decreasing machine down time.

These and other objects of the invention will become more apparent as the following description proceeds, especially when considered with the accompanying drawing.

DETAILED DESCRIPTION

Figure 1:
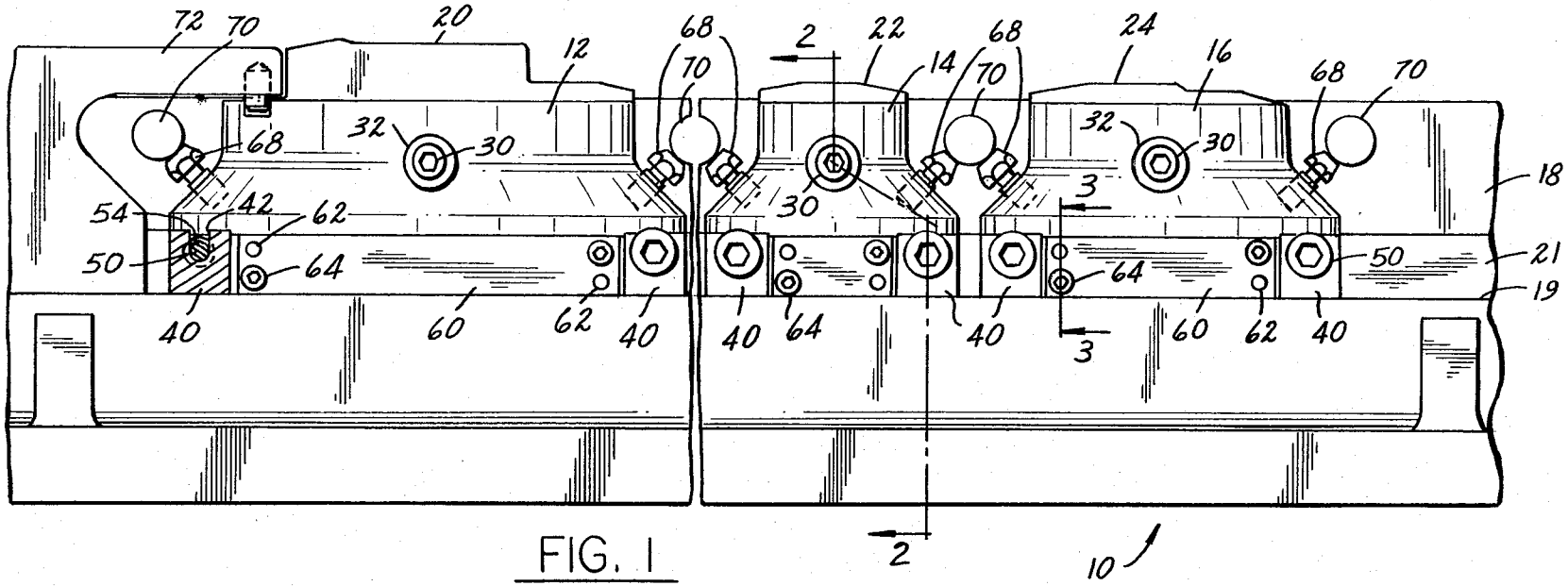
FIG. 1 is an elevational view of an adjustable cam bar assembly constructed in accordance with the invention. One of the wedges is sectioned to show the relationship between the wedge slot and the shank of the bolt therein.
Figure 2:
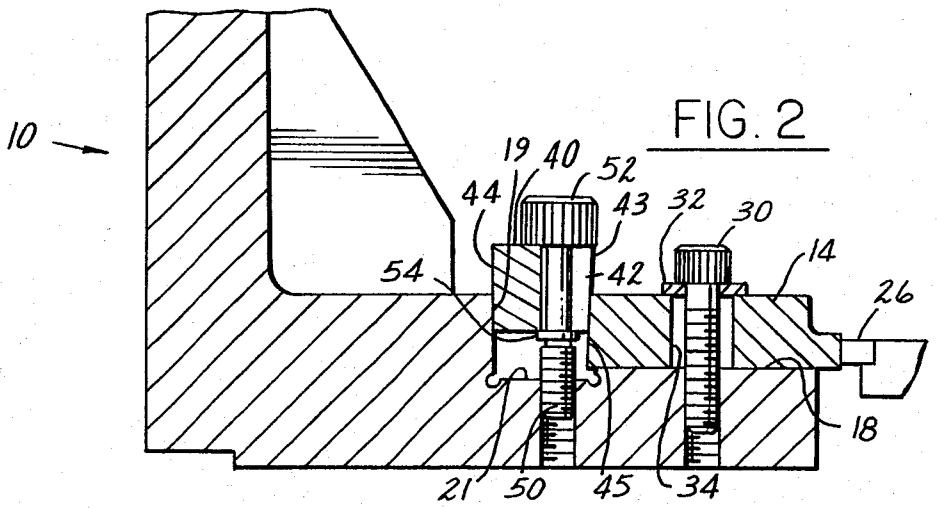
FIG. 2 is a sectional view taken on the line 2—2 in FIG. 1.
Figure 3:
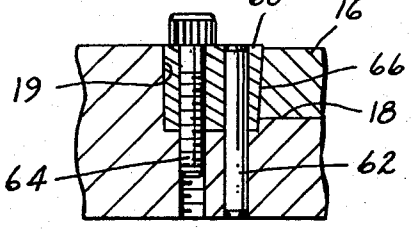
FIG. 3 is a fragmentary sectional view taken on the line 3—3 in FIG. 1.

Referring now more particularly to the drawing, there is shown an elongated cam bar or support 10 on which are mounted a plurality of cams 12, 14 and 16.

The cam bar has an elongated flat supporting surface 18. The cam bar also has an elongated flat abutment surface 19 projecting away from the support surface at right angles thereto. A recess 21 is formed in supporting surface 18 adjacent to abutment surface 19. The cams 12, 14 and 16 are mounted on the support surface in spaced relation along the length thereof. Each cam has a specially contoured front surface 20, 22, 24. A single stylus 26 is provided to sweep over the front surfaces of the cams and guide a diamond dress (not shown) across the periphery of a series of grinding wheels to dress the wheels. The front surface of each cam is contoured to put the desired profile on the periphery of a particular grinding wheel.

Each cam is mounted on the supporting surface 18 and clamped thereto by a bolt 30 and washer 32. The bolt 30 passes through an enlarged hole 34 in the cam and threads into the cam bar.

Each cam is located or positioned on the supporting surface 18 a predetermined distance from the abutment surface 19 by a pair of wedges 40 located above recess 21. Each wedge has a square cut rear surface 44 for a sliding, full surface engagement with the abutment surface 19, and also has a tapered front surface 43 engageable with a similarly tapered rear surface 45 of the cam. Each wedge has a slot 42 which extends from top to bottom and opens through the front. Each wedge is secured to the cam bar by a bolt 50 which passes through the slot and threads into the cam bar. The bolt has a head 52 above the wedge and a collar 54 beneath the wedge. The width of the slot 42, as seen at the left in FIG. 1, approximates the diameter of the shank of the bolt. The head 52 and collar 54 are larger in diameter so that the wedge may be raised or lowered by the head or by the collar when the bolt is raised or lowered. Obviously, when the bolt is lowered, that is threaded more deeply into the cam bar, the wedge is driven down and forces the cam in a forward direction. The wedge is capable of being moved downward until it contacts the bottom of recess 21. The hole 34 in each cam is oversized to allow for the full range of adjustment which can be effected by the pair of wedges.

The wedges for each cam are spaced apart and between them is a spacer block 60. Each spacer block 60 is located in the recess 21 by dowel pins 62 and secured by bolts 64. The front surface 66 of each spacer block is tapered at the same angle as the rear surface 45 of the cam. The spacer blocks serve as means of limiting the rearward adjustment of the cams.

Locking screws 68 firmly press the cams against the wedges 40. Two locking screws are provided for each cam, threading into opposite sides of the base of the cam and extending from the cam at a 45° angle to the rear surface. The locking screws are threaded outwardly until their heads abut pins 70 which project up from supporting surface 18. By properly adjusting the locking screws 68, the cams are not only pressed firmly against the wedges 40, but also may be shifted slightly lengthwise of the supporting surface 18.

A safety stop 72 is provided to prevent the stylus from dropping off the cam at one end of the series.

In use, the bolts 30 are loosened and the wedges 40 adjusted up or down to obtain the desired forward projection of the cams. The locking screws 68 are threaded outwardly until the heads thereof engage the pins 70, thus pressing the rear surfaces 45 of the cams against the front surfaces 43 of the wedges and also shifting the cams slightly one way or the other along the length of the supporting surface 18, if desired. The bolts 30 are then tightened to clamp the cams in adjusted position. If the wedges 40 are removed or adjusted upwardly far enough, the spacer blocks 60 will provide a limit of rearward adjustment of the cams. The stylus 26 may then sweep over the front surfaces of the cams and guide the diamond dresser across the grinding wheels.

If an individual cam becomes damaged or worn out, it may be quickly and easily removed, by unscrewing the bolt 30, and replaced. Wedges 40 can also be removed by unscrewing bolts 50, and the bolts 50 may be separated from the wedges through the open front of slots 42.

It has been found that the adjustable cams of this invention need be made to a tolerance of only ±0.001" instead of ±0.000025" as heretofore required.

I claim:

1. An adjustable cam bar assembly for use in guiding a dresser for the grinding wheels of a multi-wheel grinder or the like, comprising a support having an elongated cam support surface and an abutment surface disposed at a substantial angle to said support surface, a plurality of cams on said support surface along the length thereof, each cam having a contoured surface on the side thereof remote from said abutment surface adapted to be engaged by the stylus of a dresser in a dressing operation, and means for individually mounting each cam on said support surface in transversely adjusted position in which its contoured surface projects a predetermined distance from said abutment surface comprising a wedge between said abutment surface and each cam and capable of being advanced or retracted to precisely locate said cam in adjusted position, means for individually advancing and retracting each wedge, and means for clamping each cam in adjusted position.

2. An adjustable cam bar assembly for use in guiding a dresser for the grinding wheels of a multi-wheel grinder or the like, comprising a support having an elongated cam support surface and an abutment surface disposed at a substantial angle to said support surface, a plurality of cams on said support surface along the length thereof, each cam having a contoured surface on the side thereof remote from said abutment surface adapted to be engaged by the stylus of a dresser in a dressing operation, and means for individually mounting each cam on said support surface in transversely adjusted position in which its contoured surface projects a predetermined distance from said abutment surface comprising a pair of wedges between said abutment surface and each cam and capable of being advanced or retracted to precisely locate said cam in adjusted position, screws threaded into said support surface for individually advancing and retracting each wedge, and means for clamping each cam in adjusted position.

3. An adjustable cam bar assembly as defined in claim 2, including a fixed abutment between each pair of wedges providing a limit of adjustment of each cam in one direction.

4. An adjustable cam bar assembly as defined in claim 3, wherein said support surface has an elongated recess therein adjacent said abutment surface and beneath said wedges and fixed abutments, said fixed abutments being seated in said recess and said screws threading into said recess.

5. An adjustable cam bar assembly as defined in claim 4, wherein said clamping means comprises individually operable locking elements associated with each cam adapted to apply force thereagainst at opposite acute angles with respect thereto to press said cam firmly against said wedges and to effect slight longitudinal shifting thereof, if desired.

* * * * *